United States Patent [19]

Ohno et al.

[11] Patent Number: 4,762,982

[45] Date of Patent: Aug. 9, 1988

[54] METHOD AND DEVICE FOR SUPPLYING ELECTRIC CURRENT TO CERAMIC HEATERS

[75] Inventors: Michio Ohno, Kokubu; Noriyoshi Nakanishi, Hayatocho; Michihiko Miyasaka, Kokubu; Yoshinori Shiraiwa, Kyoto, all of Japan

[73] Assignee: Kyocera Corporation, Kyoto, Japan

[21] Appl. No.: 907,074

[22] Filed: Sep. 12, 1986

[30] Foreign Application Priority Data

| | | | |
|---|---|---|---|
| Sep. 14, 1985 | [JP] | Japan | 60-203999 |
| Sep. 30, 1985 | [JP] | Japan | 60-150212[U] |
| Oct. 31, 1985 | [JP] | Japan | 60-245583 |

[51] Int. Cl.[4] ..... H05B 1/02

[52] U.S. Cl. ..... 219/508; 219/505; 219/492; 219/507; 219/205; 219/202; 219/262; 123/179 H; 123/179 BG

[58] Field of Search ..... 219/202–206, 219/508, 509, 262, 492, 493, 497, 501, 504, 505, 279, 267; 123/179.B, 179.BG, 145 A, 179 H

[56] References Cited

U.S. PATENT DOCUMENTS

| | | | |
|---|---|---|---|
| 4,215,268 | 7/1980 | Dinkel | 219/501 |
| 4,258,240 | 3/1981 | Pless | 219/10.81 |
| 4,348,583 | 9/1982 | Bube et al. | 219/492 |
| 4,375,205 | 3/1983 | Green | 219/492 |
| 4,478,181 | 10/1984 | Kikuchi et al. | 219/492 |

*Primary Examiner*—M. H. Paschall

*Attorney, Agent, or Firm*—Spensley, Horn, Jubas & Lubitz

[57] ABSTRACT

Method and device for supplying electric current to ceramic heaters comprising heating resistors embedded in ceramic sintered bodies, being characterized in that direct current is supplied from a direct current supply circuit as the first current supply step and the direction of the direct current supplied to the heating resistors at the first current supply step is reversed by a switching circuit or alternate current is supplied as the second current supply step in order to eliminate or considerably reduce cracking of the ceramic sintered bodies of the ceramic heaters when the heaters are repeatedly used for a long time at high temperatures.

21 Claims, 8 Drawing Sheets

METHOD AND DEVICE FOR SUPPLYING ELECTRIC CURRENT TO CERAMIC HEATERS

BACKGROUND OF THE INVENTION

1. Field of the Invention

The present invention relates to a method and a device for supplying electric current to ceramic heaters, for example used as glow plugs to facilitate a starting of a diesel engine.

2. Prior Art

Conventionally, high voltage $V_1$ is applied in the initial current supplying period to abruptly heat the ceramic glow plug for a diesel engine, for example to about 900° C. in about three seconds after every starting of the engine as shown in FIG. 12. When the temperature of the glow plug reaches about 900° C. (at which temperature the sintered body of the glow plug is not cracked and the glow plug can perform ignition), low voltage $V_2$ is applied to maintain the stable saturation temperature (about 1,150° C.). Then current supply is stopped. In this way, one cycle is completed to facilitate the starting of the diesel engine.

In this one cycle or in the repetition of such a cycle for an extended period, DC voltage is generally applied, with its polarity being fixed, from a battery to the glow plug. Accordingly, when such voltage is repeatedly applied in the method of supplying electric current of this type, substance movement occurs in the ceramic sintered body highly heated at 1,150° C. or more, resulting in generation of cracks in the ceramic sintered body. Therefore, it is difficult to use the glow plug at high temperatures.

Generally, it is well known that the cracks in the ceramic sintered body of a ceramic heater causes the breakage of the ceramic sintered body and the ceramic heater cannot function properly. This is a serious problem in use of the ceramic heater for a diesel engine's glow plug which must be highly reliable and durable. Accordingly, a ceramic heater which does not cause cracks in its ceramic sintered body even after its repetitive use for an extended period is desired to be developed.

SUMMARY OF THE INVENTION

The applicant of the present invention studied earnestly to solve the above problem and found that ceramic sintered body was not cracked in one cycle of the above-mentioned electric current supply cycle or in the repetition of such a cycle for an extended period at relatively high temperatures by reversing the direction of the direct current supplied to the heater from the direction determined at the first current supplying step to the opposite direction at the second current supplying step or by supplying alternate current at the second current supplying step.

It is therefore the object of the present invention to provide a method and a device for supplying electric current to ceramic heaters so that the ceramic sintered body of the ceramic heater is hardly cracked, the ceramic heater can be used repeatedly at high temperatures and electric current can be supplied to the ceramic heater for an extended period at high temperatures to ensure high durability and reliability.

The present invention provides a method of supplying electric current to ceramic heaters composed of heating resistors embedded in ceramic sintered bodies. The method is characterized in that the method comprises the first current supplying step wherein direct current is supplied to the heating resistors and the second current supplying step wherein the direction of the direct current supplied at the first current supplying step is reversed or alternate current is supplied to the heating resistors. The present invention also provides a device for heating the ceramic heaters composed of heating resistors embedded in ceramic sintered bodies. The device is characterized in that the device comprises a direct current supply circuit which supplies direct current to the ceramic heaters at the first current supplying step, a switching circuit which switches the first current supplying step to the second current supplying step so that the direction of the direct current supplied at the first current supplying step is reversed or alternate current is supplied to the heating resistors, and a power switching means to control the ceramic heaters. There are two embodiments of the current supplying method of the present invention.

(1) The polarity of direct current is reversed in the current supply control cycle.

(2) Direct current is switched to alternate current. (The direction of the current to the heating resistors is reversed.)

The current supply control circuit of embodiment (1) should be constructed so that the polarity of the direct current from a battery to glow plugs for example is switched from (+) to (−) or (−) to (+). The current supply control circuit of embodiment (2) should be constructed so that direct current is supplied from the battery to glow plugs for example at the initial step and alternate current is supplied from an alternator for example at the time of temperature saturation. The glow plugs used for types (1) and (2) have no body-grounding terminals. If a terminal is body-grounded, the terminal is fixed to negative (−). Thus, the polarity cannot be changed. The embodiments of the present invention will be detailed refering to the accompanying drawings.

BRIEF DESCRIPTION OF THE DRAWINGS

FIG. 6 (*b*) is a sectional view of the sintered body of the double-wire glow plug with two terminals;

DETAILED DESCRIPTION OF THE PREFERRED EMBODIMENTS

Before the embodiments of the current supply device of the present invention are detailed, typical diesel engine glow plugs are described below as ceramic heaters used for the following embodiments.

Figure 5:
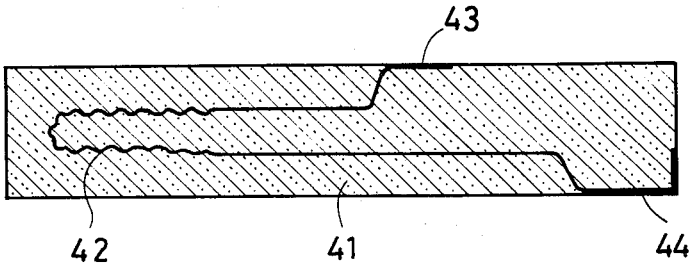
FIG. 5 is a sectional view of the sintered body of the single-wire glow plug.
Figure 6:
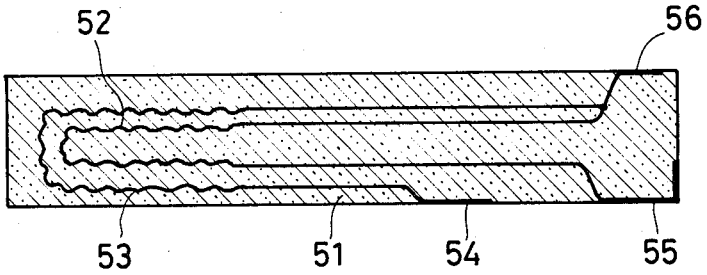
FIG. 6 (*a*) is a sectional view of the sintered body of the double-wire glow plug with three terminals.
Figure 6:
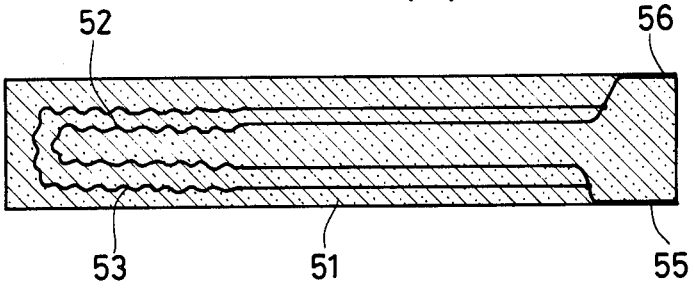

FIG. 5 shows the ceramic heater section of a single-wire glow plug (two-terminal type). One heating resistor wire 42 is embedded in a ceramic sintered body 41. A negative terminal 43 and a positive terminal 44 are provided to the ceramic heater. FIG. 6 (*a*) shows the ceramic heater section of a double-wire glow plug (three-terminal type). Two heating resistor wires 52 and 53 are embedded in a ceramic sintered body 51. A negative (positive) terminal 54, a positive (negative) terminal 55 and a common terminal 56 are provided to the ceramic heater. FIG. 6 (*b*) shows the ceramic heater section of a double-wire glow plug (two-terminal type). Two heating resistor wires 52 and 53 are embedded in a ceramic sintered body 51 and connected near the terminals as shown. A negative (positive) terminal 55 and a positive (negative) terminal 56 are provided to the ceramic heater.

These glow plugs are made as described below. Mixed powder material in which a sintering assistant such as an oxide of a IIa-element group or a IIIa-element group is added to silicon nitride ($Si_3N_4$) is filled in a hot press mold. The heating resistor wires (made of molybdenum or tungsten for example having a high melting point) 42 or 52 and 53 are placed on the mold. Furthermore, the mixed powder material is placed over the heating resistor wires. These layers are sintered under high temperature and high pressure to form a sintered body. The surface of this sintered body is ground and terminals 43, 44, 54, 55 and 56 are exposed. Electrodes are formed on the surfaces of the terminals 43, 44, 54, 55 and 56 by means of metalization, plating or brazing.

A glow plug is produced by providing a metallic pipe holder and external connection terminals (not shown) to the ceramic heater. The tip of the sintered body (heater section) remains exposed.

(EMBODIMENT 1)

Figure 1:
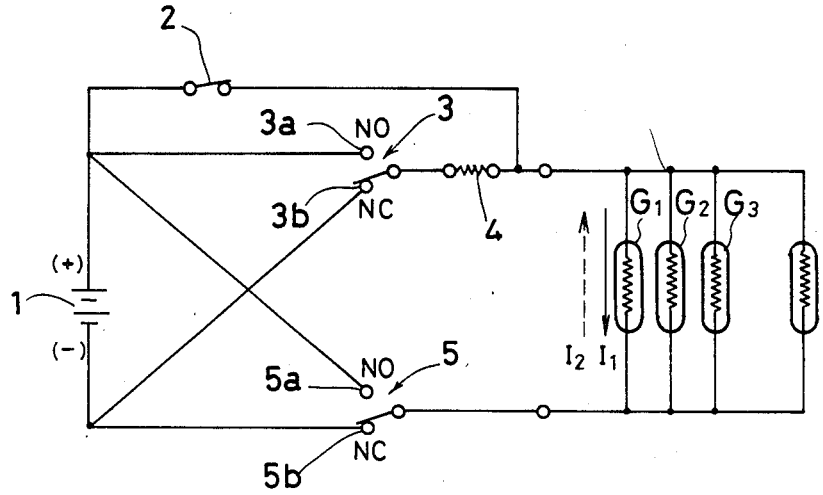
FIG. 1 illustrates a current supply control circuit of the present invention applied to DC voltage application type of single-wire glow plugs.

FIG. 1 shows an embodiment of a current supply device (comprising a current supply control circuit) of the present invention applied to DC voltage application type of single-wire glow plugs (each of which has one embedded heating wire and two terminals as shown in FIG. 5).

In FIG. 1, a relay 2 and a two-contact relay 3 which form switching circuits, are connected in parallel to the positive (+) terminal of a battery 1 which is a DC power supply of the direct current supply circuit of the current supply control circuit. The relay 2 is connected to the positive terminals of glow plugs $G_1$, $G_2$, $G_3$, . . . (hereafter generally referred to as G). The two-contact relay 3 is connected to the positive terminal of the glow plug G via a dropping resistor 4 which forms a temperature saturation control circuit. The negative (−) terminal of the battery 1 is connected to the negative terminal of the glow plug G via the normal-close contact **5*b* of a two-contact relay 5 which forms a switching circuit. The positive (+) terminal of the battery 1 is also connected to the normal-open contact 5*a* of the two-contact relay 5 and the negative (−) terminal of the battery 1 is also connected to the normal-close contact 3*b* of the two-contact relay 3**.

This current supply control circuit functions as described below. When a key switch (not shown) is turned on to start an engine, the relay 2 which is interlocked with the key switch turns on. As the first current supply step, current flows to the glow plug G in the direction indicated by the solid line arrow I1. The glow plug G is abruptly heated. After a predetermined time (three seconds for example), the relay 2 is turned off by a timer (not shown). At the same time, the two-contact relay 3 switches to the normal-open contact **3*a* and the current from the battery 1 is supplied to the glow plug G via the dropping resistor 4 which forms a temperature saturation control circuit. At this step, the glow plug G is heated to a constant saturation temperature (1,150° C. for example). The two-contact relay 3 is then switched to the normal-close contact 3*b* and the two-contact relay 5 is also switched to the normal-open contact 5*a* by an external circuit (not shown) at a predetermined time. The polarity of the DC voltage applied from the battery 1 to the glow plug G is reversed at this second current supply step. As a result, the current flow direction is changed from the direction indicated by the solid line arrow I1 to the direction indicated by the dotted line arrow I2. After the predetermined time, the two-contact relay 5 is switched to the normal-close contact 5*b*** by the glow plug power switch of an external circuit. Current to the glow plug G is stopped and one cycle is completed.

(EMBODIMENT 2)

Figure 2:
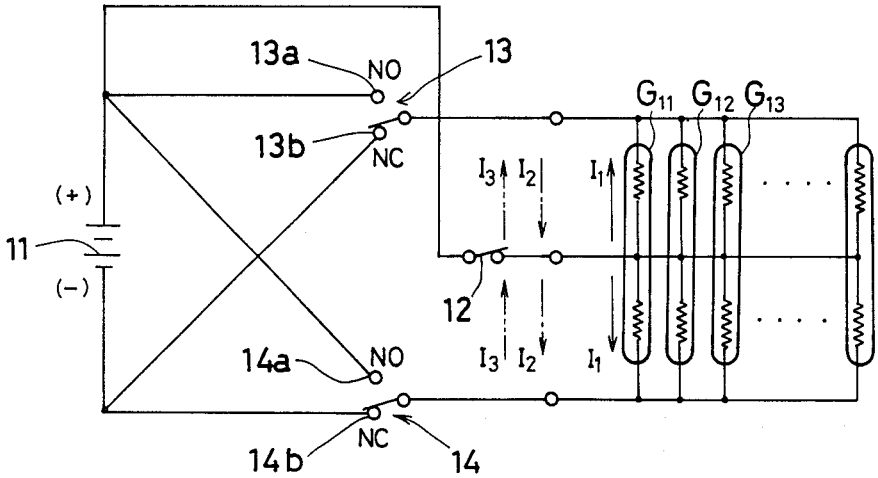
FIG. 2 illustrates a current supply control circuit of the present invention applied to DC voltage application type of double-wire glow plugs.

FIG. 2 shows an embodiment of a current supply device (comprising a current supply control circuit) of the present invention applied to DC voltage application type of double-wire glow plugs (each of which has two embedded heating wires and three terminals as shown in FIG. 6 (*a*)).

In FIG. 2, a relay 12 and a two-contact relay 13 which form switching circuits, are connected in parallel to the positive (+) terminal of a battery 11 which is a DC power supply of the direct current supply circuit of the current supply control circuit. The relay 12 is connected to the common terminals of glow plugs $G_{11}$, $G_{12}$, $G_{13}$, . . . (hereinafter referred to as G). The two-contact relay 13 is connected to the positive terminal of the glow plug G. The negative (−) terminal of the battery 11 is connected to the negative terminal of the glow plug G via the normal-close contact **14*b* of a two-contact relay 14 which forms a switcing circuit. The positive (+) terminal of the battery 11 is also connected to the normal-open contact 14***a* of the two-contact relay 14 and the negative (−) terminal of the battery 11 is connected to the normal-close contact 13*b* of the two-contact relay 13.

This current supply control circuit functions as described below. When the relay 12 is turned on for starting, current flows to the two heating resistor wires of each glow plug G in parallel in the direction indicated by the solid line arrow $I_1$ as the first current supply step. The glow plug G is abruptly heated. After a predetermined time (three seconds for example), the relay 12 is turned off by a timer (not shown). At the same time, the two-contact relay 13 is switched to the normal-open contact 13*a* and the current from the battery 11 is supplied from the positive terminal of each glow plug G to the two heating resistor wires of each glow plug G in the direction indicated by the dash and dotted line $I_2$. The glow plug G is heated to a constant saturation temperature (1,150° C. for example). After a predetermined time, two-contact relay 13 is switched to the normal-close contact 13*b* and the two-contact relay 14 is also switched to the normal-open contact 14*a* by an external circuit as the second current supply step. As a result, the direction of the current flow from the battery 11 is reversed from the direction indicated by the dash and dotted line arrow $I_2$ to the direction indicated by the dash and two-dotted line arrow $I_3$. After a predetermined time, the two-contact relay 14 is switched to the normal-close contact 14*b* by the glow plug power switch. Current to the glow plug G is thus stopped and one cycle is completed.

(EMBODIMENT 3)

Figure 3:
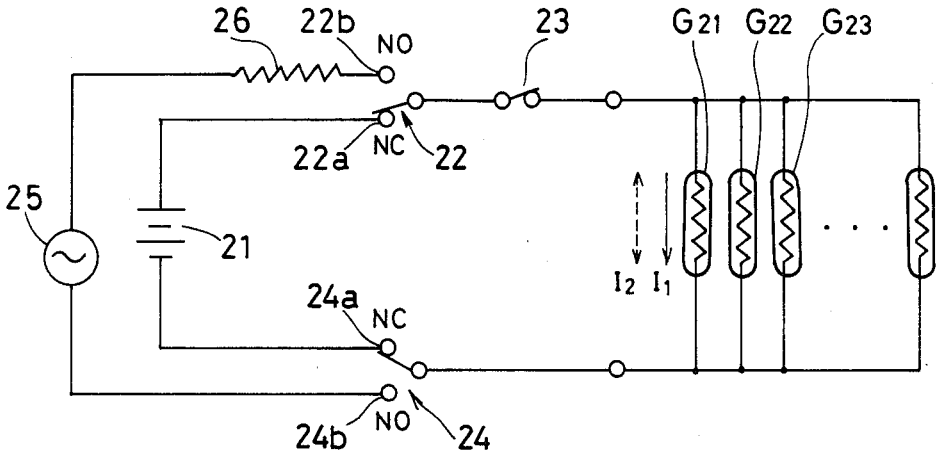
FIG. 3 illustrates a current supply control circuit of the present invention applied to DC-AC voltage application type of single-wire glow plugs.

FIG. 3 shows an embodiment of a current supply device (comprising a current supply control circuit) of the present invention applied to DC-AC voltage application type of single-wire glow plugs.

In FIG. 3, the positive (+) terminal of a battery 21 which is a DC power supply of the direct current supply circuit is connected to the positive terminals of glow plugs $G_{21}$, $G_{22}$, $G_{23}$, . . . via the normal-close contact 22*a* of a two-contact relay 22 and a relay 23 which is interlocked with an engine key switch (not shown).

The negative (−) terminal of the battery 21 is connected to the negative terminals of the glow plugs $G_{21}$, $G_{22}$, $G_{23}$, . . . via the normal-close contact 24*a* of the two-contact relay 24. In addition, one terminal of an alternator 25 which is an AC power supply is connected to the positive terminals of the glow plugs $G_{21}$, $G_{22}$, $G_{23}$, . . . via a dropping resistor 26 which forms a temperature saturation control circuit, the normal-open contact 22*b* of the two-contact relay 22 and the relay 23. The other terminal of the alternator is connected to the negative terminals of the glow plugs $G_{21}$, $G_{22}$, $G_{23}$, . . . via the normal open contact 24*b* of the two-contact relay 24.

This current supply control circuit functions as described below. When a key switch (not shown) is turned on to start an engine after the two-contact relays 22 and 24 are switched to the normal-close contacts 22*a* and 24*a*, the relay 23 which is interlocked with the key switch turns on. As the first current supply step, direct current from the battery 21 flows to the heating resistor wires of the glow plugs $G_{21}$, $G_{22}$, $G_{23}$, . . . in the direction indicated by the solid line arrow I1. The glow plugs are abruptly heated. After a predetermined time (three seconds for example), the relays 22 and 24 are switched to the normal-open contacts 22*b* and 24*b* by a timer (not shown). The AC power supply of the alternator 25 is connected to the glow plugs $G_{21}$, $G_{22}$, $G_{23}$, . . . via the dropping resistor 26 which forms a temperature saturation control circuit and alternate current flows in the direction inidcated by the dotted line arrow $I_2$ as the second current supply step. The glow plugs are heated to a constant saturation temperature (1,150° C. for example). Since the polarity of the AC voltage is periodically reversed between (+) and (−), alternate current whose polarity is periodically reversed is supplied to the glow plugs $G_{21}$, $G_{22}$, $G_{23}$, . . . After a predetermined time, the relay 23 is turned off and the two-contact relays 22 and 24 are switched to the normal-close contacts 22*b* and 24*b* by the glow plug power switch of an external circuit. Current to the glow plugs is stopped and one cycle is completed.

(EMBODIMENT 4)

Figure 4:
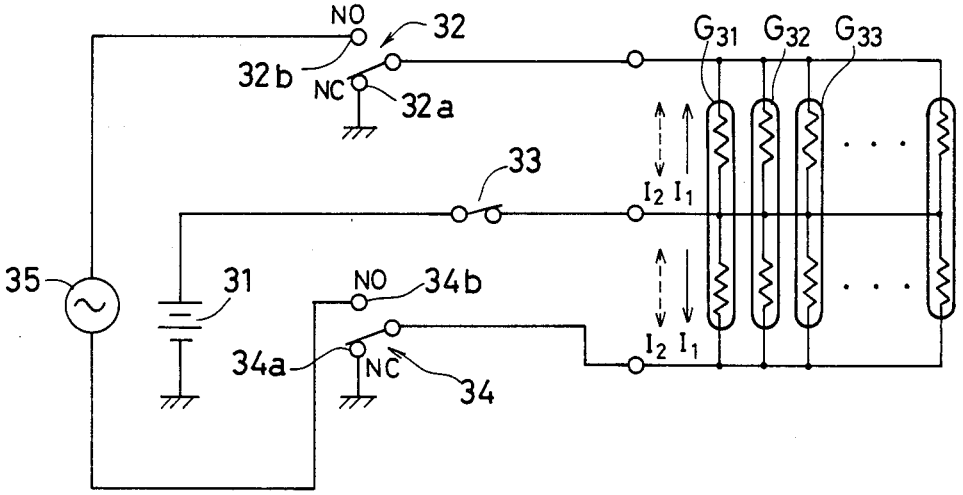
FIG. 4 illustrates a current supply control circuit of the present invention applied to DC-AC voltage application type of double-wire glow plugs.

FIG. 4 shows an embodiment of a current supply device (comprising a current supply control circuit) of the present invention applied to DC-AC voltage application type double-wire glow plugs.

In FIG. 4, the positive (+) terminal of a battery 31 which is a DC power supply of the direct current supply circuit is connected to the central terminals of glow plugs $G_{31}$, $G_{32}$, $G_{33}$, . . . via a relay 33 which forms a switching circuit. The negative (−) terminal of the battery 31 is grounded. Furthermore, one terminal of an alternator 35 which is an AC power supply is connected to the terminals (top terminals in FIG. 4) of the glow plugs $G_{31}$, $G_{32}$, $G_{33}$, . . . via the normal-open contact 32*b* of a two-contact relay 32. The other terminal of the alternator is connected to the other terminals (bottom terminals in FIG. 4) of the glow plugs $G_{31}$, $G_{32}$, $G_{33}$, . . . via the normal-open contact 34*b* of a two-contact relay 34. The normal-close contacts 32*a* and 34*a* of the two-contact relays 32 and 34 are grounded.

The current supply control circuit functions as described below. When the relay 33 is turned on for starting, direct current flows to the heating resistor wires of the glow plugs $G_{31}$, $G_{32}$, $G_{33}$, . . . in the direction indicated by the solid line arrow $I_1$ as the first current supply step since the normal-close contacts 32*a* and 34*a* of the two-contact relays 32 and 34 are grounded. The glow plugs are abruptly heated. After a predetermined time (three seconds for example), the relay 33 is turned off and the relays 32 and 34 are switched to the normal-open contacts 32*b* and 34*b* by a timer (not shown). The alternator 35 is connected to the glow plugs $G_{31}$, $G_{32}$, $G_{33}$, . . . Alternate current flows in the two series-connected heating wires of each glow plug in the direction indicated by the dotted line arrow $I_2$ as the second current supply step. The glow plugs are heated to a constant saturation temperature (1,150° C. for example). Since the polarity of the AC voltage are periodically reversed between (+) and (−), alternate current whose polarity is periodically reversed is supplied to the glow plugs $G_{31}$, $G_{32}$, $G_{33}$, . . .

(EMBODIMENT 5)

Figure 11:
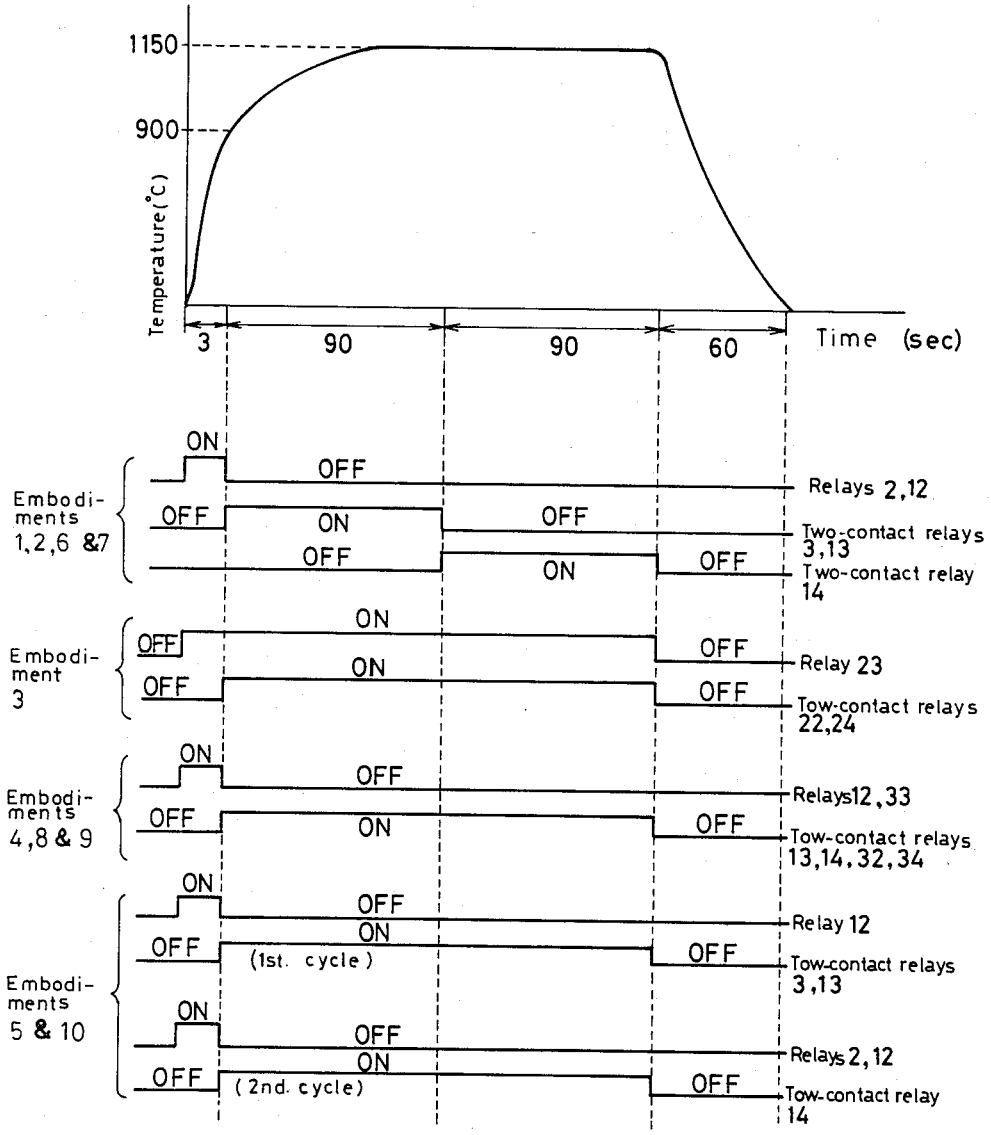
FIG. 11 is a temperature change pattern diagram compared with relay switching control patterns.
Figure 12:
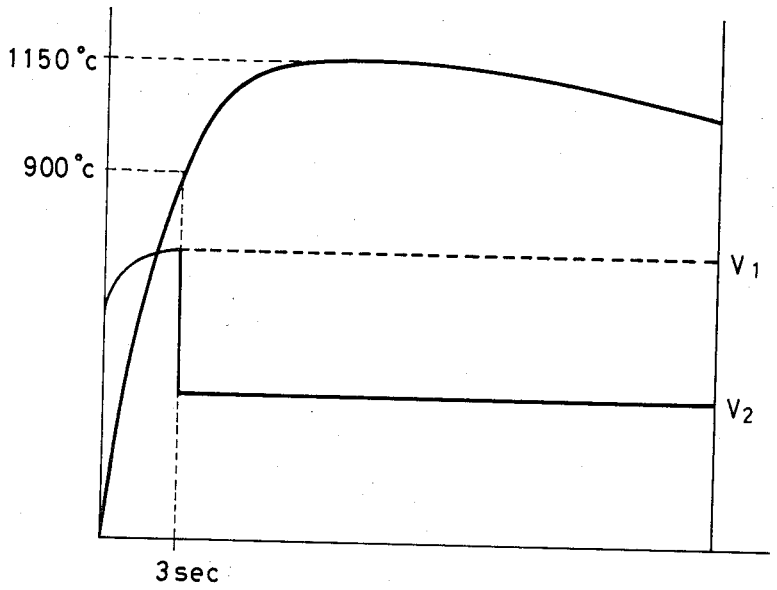
FIG. 12 is a diagram illustrating the abrupt temperature rise and temperature saturation characteristics of generally used glow plugs.

A current supply method different from those of embodiments 1 and 2 is adopted using the current supply control circuits shown in FIGS. 1 and 2. In embodiment 5 (the switching control patterns of the switching circuits of embodiment 5 are shown in FIG. 11), the relay 2 or 12 is turned on to abruptly heat the glow plugs G. After a predetermined time (three seconds for example), the relay 2 or 12 is turned off by a timer (not shown).

The two-contact relay 3 or 13 is switched to the normal-open contact 3*a* or 13*a*. Current is supplied to the glow plug G to maintain the predetermined saturation temperature. After a predetermined time, the relay 3 or 13 is switched to stop current supply to complete the cycle. In this cycle, current flows unidirectionally in the heating resistor wires of the glow plugs. This cycle is regarded as the first current supply step. In this first cycle, the relay 5 or 14 is not activated.

The second cycle begins when the relay 2 or 12 is turned on. The glow plug G is abruptly heated. After a predetermined time (three seconds for example), the relay 2 or 12 is turned off by a timer (not shown). The two-contact relay 3 or 13 remains at the normal-close contact 3*b* or 13*b*, but the two-contact relay 5 or 14 is switched to the normal-close contact 5*a* or 14*a* in this second cycle. At this time, current flows in the heating resistor wires of the glow plugs $G_1$, $G_2$, $G_3$, . . . or $G_{11}$, $G_{12}$, $G_{13}$, . . . in the direction opposite to the current direction of the first cycle. After a predetermined time, the relay 5 or 14 is switched to stop supplying current to the glow plug G and the second cycle is completed. In this second cycle, the relay 3 or 13 is not activated. Only the relay 5 or 14 is activated.

In the case of embodiments 1 and 2, the direction of the current supplied to the glow plug G is reversed once in one cycle between the start and stop of current supply to the glow plug G. In this embodiment, however, the direction of the current supplied to the glow plug G is controlled to be reversed in every other cycle.

In this embodiment, the first current supply step is switched to the second current supply step when the direction of the direct current is reversed. The step can also be switched when direct current is switched to alternate current.

There are various methods of switching direct current to alternate current. Three methods are taken as examples: only one time of switching from direct current to alternate current, numerous times of switching, and continuous use of alternate current after direct current is switched to alternate current. These methods can be used.

(EMBODIMENT 6)

Figure 7:
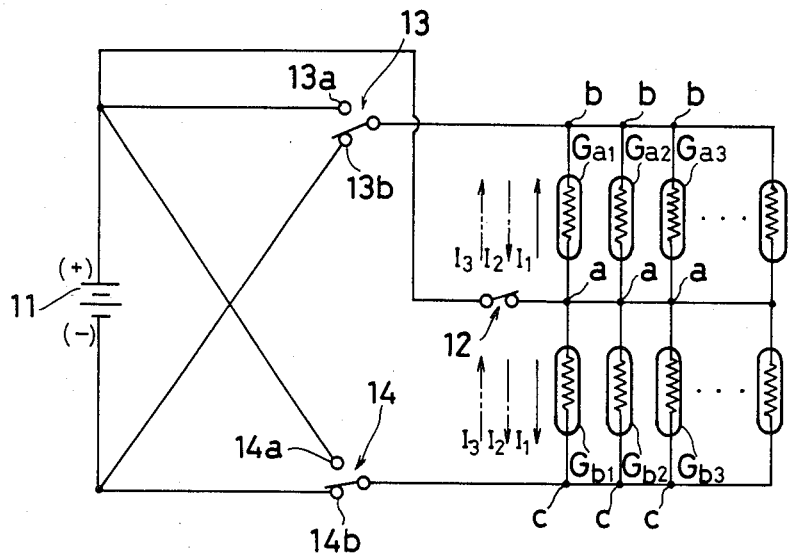
FIG. 7 illustrates a current supply control circuit of the present invention applied to series-parallel switching DC voltage application type of single-wire glow plugs.

The wiring of this embodiment 6 is practicaly the same as that of embodiment 2 since the double-wire glow plug with three terminals of embodiment 2 is replaced with a pair of single-wire glow plugs Ga and Gb. In FIGS. 7 and 2, like reference characters designate like parts.

As shown in FIG. 7, embodiment 6 has pairs of DC voltage application type single-wire glow plugs Ga1 and Gb1, Ga2 and Gb2, . . . , each pair of the glow plugs are connected in parallel initially and then connected in series at the time of temperature saturation to the DC power supply battery which forms a direct current supply circuit. More particularly, the positive (+) terminal of the DC power supply battery 11 is connected to the common terminals a of the pairs of the glow plugs Ga1 and Gb1, Ga2 and Gb2, Ga3 and Gb3, . . . via the relay 12 which forms a switching circuit and also connected to the terminals b of the glow plugs Ga1, Ga2, Ga3, . . . via the normal-open contact 13*a* of the two-contact relay 13 which forms a switching circuit. The negative (−) terminal of the battery 11 is connected to the terminals c of the glow plugs Gb1, Gb2, Gb3, . . . via the normal-close contact 14*b* of the two-contact relay 14 which forms a switching circuit. In addition, The negative (−) terminal of the battery 11 is connected to the terminals b of the glow plugs Ga1, Ga2, Ga3, . . . via the normal-close contact 13*b* of the two-contact relay 13, and the positive (+) terminal of the battery 11 is connected to the terminals c of the glow plugs Gb1, Gb2, Gb3, . . . via the normal-open contact 14*a* of the two-contact relay 14.

The function of this current supply control circuit is described below. When the relay 12 is turned on for starting, the power supply battery 11 (positive (+) terminal) is connected in parallel to the glow plugs Ga1, Gb1, . . . and current flows in the heating resistor wires of the glow plugs in the direction indicated by the solid line arrow $I_1$ as the first current supply step. The glow plugs are abruptly heated. After a predetermined time (three seconds for example), the relay 12 is turned off and the two-contact relay 13 is switched to the normal-open contact 13*a* by a timer (not shown). As the second current supply step, the battery 11 (the positive (+) terminal) is connected in series from the terminals b to the glow plugs Ga1, Ga2, Ga3, . . . , and Gb1, Gb2, Gb3, . . . Current flows in the heating resistor wires of the glow plugs in the direction indicated by the dash and dotted line arrow $I_2$. The terminals c of the glow plugs are connected to the negative terminal (−) of the battery 11 via the normal-close contact 14*b* of the two-contact relay 14. The glow plugs are heated to a constant saturation temperature (1,250° C. for example). In this case, only the polarities of the glow plugs Ga1, Ga2, Ga3, . . . are reversed. After a predetermined time, the two-contact relay 13 is switched to the normal-close contact 13*b* and the two-contact relay 14 is switched to the normal-open contact 14*a*, and current from the positive (+) terminal of the battery 11 flows in the heating resistor wires of the glow plugs Ga1, Gb1, . . . in the direction indicated by the dash and two-dotted line arrow $I_3$.

(EMBODIMENT 7)

Figure 8:
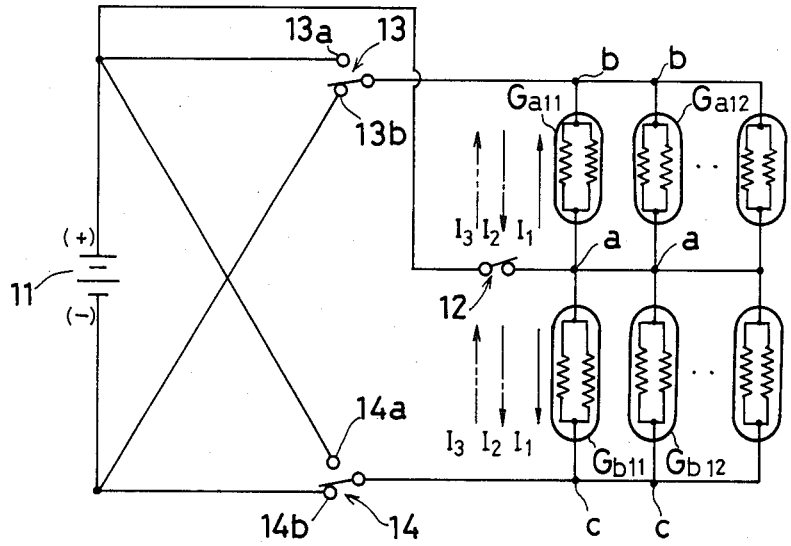
FIG. 8 illustrates a current supply control circuit of the present invention applied to series-parallel switching DC voltage application type of double-wire glow plugs.

As shown in FIG. 8, embodiment 7 has pairs of DC voltage application type double-wire glow plugs Ga11 and Gb11, Ga12 and Gb12, . . . , each pair of the glow plugs are connected in parallel initially and then connected in series at the time of temperature saturation to the DC power supply battery 11. The construction and function of embodiment 7 are practicaly the same as those of embodiment 6 since the single-wire glow plugs Ga1, Gb1, . . . of embodiment 6 are replaced with double-wire glow plugs Ga11, Gb11, . . . In FIGS. 7 and 8, like reference characters designate like parts. Therefore, the explanation of embodiment 7 is omitted.

(EMBODIMENT 8)

Figure 9:
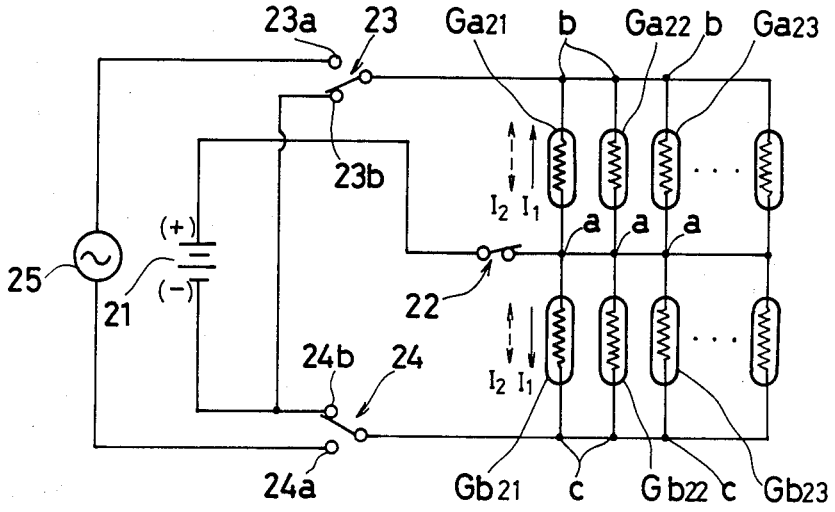
FIG. 9 illustrates a current supply control circuit of the present invention applied to series-parallel switching DC-AC voltage application type of single-wire glow plugs.

As shown in FIG. 9, embodiment 8 has pairs of series-parallel switching, DC-AC voltage application type of single-wire glow plugs Ga21 and Gb21, Ga22 and Gb22 . . . , each pair of glow plugs are connected in parallel to a DC power supply battery 21 at the initial period and connected in series to an AC power supply 25 at the time of temperature saturation. The construction and function of embodiment 8 are practically the same as those of embodiment 4 since the double-wire three-terminal glow plugs G31, . . . are respectively replaced with pairs of signal-wire two-terminal glow plugs Ga21 and Gb21, . . . In FIGS. 4 and 9, like reference characters designate like parts. Therefore, the explanation of embodiment 8 is omitted. The glow plugs Ga21, Gb21, . . . have no body-grounding terminals. If a terminal is body-grounded, the terminal is fixed to negative (−) and the polarity thereof cannot be changed anymore.

(EMBODIMENT 9)

Figure 10:
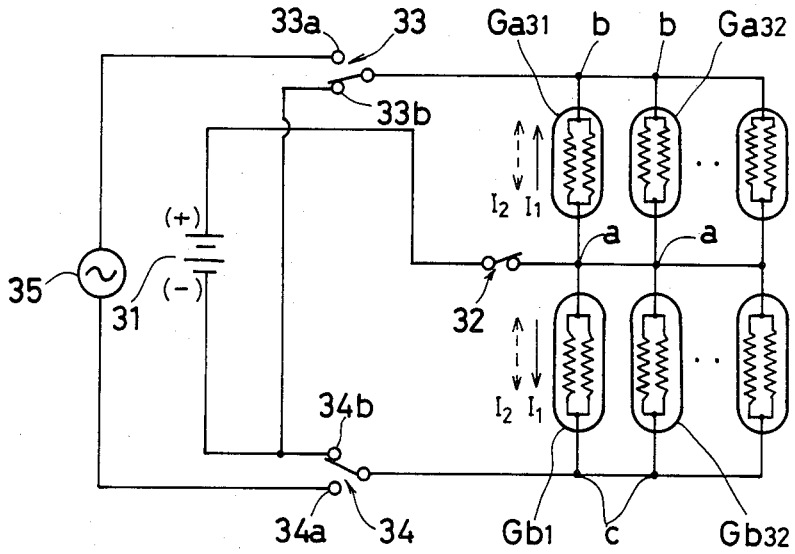
FIG. 10 illustrates a current supply control circuit of the present invention applied to series-parallel switching DC-AC voltage application type of double-wire glow plugs.

As shown in FIG. 10, the construction and function of embodiment 9 are practically the same as those of embodiment 8 since the single-wire two-terminal glow plugs Ga21, Gb21, . . . are replaced with double-wire two-terminal glow plugs Ga31, Gb31, . . . Therefore, the explanation of embodiment 9 is omitted. The glow plugs Ga31, Gb31, . . . of this embodiment have no body-grounding terminals.

(EMBODIMENT 10)

The current supply control pattern of the circuits of embodiments 6 and 7 is changed as described below. As shown in FIG. 11, the relay 12 is turned on for starting. At the first current supply step, the glow plugs Ga1, Gb1, . . . or Ga11, Gb11, . . . are abruptly heated. After a predetermined time (three seconds for example), the relay 12 is turned off and the two-contact relay 13 is switched to the normal-open contact 13*a* by a timer (not shown). As the second current supply step, current is supplied to the glow plugs Ga1, Gb1, . . . or Ga11, Gb11, . . . to obtain the temperature saturation condition. These two steps are performed as one cycle, namely the first cycle. Next, the two-contact relay 13 is returned to the normal-close contact 13*b*. The relay 12 is then turned on again for starting and the glow plugs Ga1, Gb1, . . . or Ga11, Gb11, . . . are abruptly heated at the first current supply step of the next cycle. After a predetermined time (three seconds for example), the relay 12 is turned off and the two-contact relay 14 is switched to the normal-open contact 14*a* by a timer (not shown). At this second current supply step of the next cycle, current is supplied to the glow plugs Ga1, Gb1, . . . or Ga11, Gb11, . . . to obtain the temperature saturation condition. This cycle comprising these two steps is performed after the first cycle. In this embodiment, current supply is controlled so that the polarity of the current in the first cycle is reversed in the next cycle, although the polarity in embodiments 6 and 7 is reversed in each cycle.

Ceramic of the ceramic heaters used for the present invention is non-oxided ceramic such as silicon nitride ($Si_3N_4$) or oxided ceramic such as alumina ($Al_2O_3$). The current supply method of the present invention can be applied to heaters made of these numerous ceramic sintered bodies.

(TEST EXAMPLE 1)

The current control methods of the above-mentioned embodiments 1 to 10 were used to test the ceramic glow plugs comprising heating resistor wires embedded in sintered bodies made of silicon nitride. According to the temperature change pattern shown in FIG. 11, voltage application to the ceramic plugs was repeated 1,000, 2,000, 3,000 and 5,000 cycles. The glow plugs were then examined to check for crack generation.

The results are shown in Table 1.

Twenty samples were used for each test item. The glow plugs were abruptly heated to 900° C. in about three seconds and the plug temperature was saturated at about 1,150° C. Application voltage values are listed in Table 2.

TABLE 1

| Embodiment No. | Number of cracks 1,000 cycles | 2,000 cycles | 3,000 cycles | 5,000 cycles |
|---|---|---|---|---|
| Embodiment No. 1 | 0/20 | 0/20 | 0/20 | 0/20 |
| Embodiment No. 2 | 0/20 | 0/20 | 0/20 | 0/20 |
| Embodiment No. 3 | 0/20 | 0/20 | 0/20 | 0/20 |
| Embodiment No. 4 | 0/20 | 0/20 | 0/20 | 0/20 |
| Embodiment No. 5 (2-terminal type) | 0/20 | 0/20 | 0/20 | 0/20 |
| Embodiment No. 5 (3-terminal type) | 0/20 | 0/20 | 0/20 | 0/20 |
| Embodiment No. 6 | 0/20 | 0/20 | 0/20 | 0/20 |
| Embodiment No. 7 | 0/20 | 0/20 | 0/20 | 0/20 |
| Embodiment No. 8 | 0/20 | 0/20 | 0/20 | 0/20 |
| Embodiment No. 9 | 0/20 | 0/20 | 0/20 | 0/20 |
| Embodiment No. 10 (Single wire type) | 0/20 | 0/20 | 0/20 | 0/20 |
| Embodiment No. 10 (Double wire type) | 0/20 | 0/20 | 0/20 | 0/20 |

TABLE 2

| Embodiment No. | Applied voltage (V) For abrupt temperature rise | For temperature saturation |
|---|---|---|
| Embodiment 1 | 9 | 5.4 |
| Embodiment 2 | 11 | 14.0 |
| Embodiment 3 | 9 | 5.4 (Effective value) |
| Embodiment 4 | 11 | 14.3 (Effective value) |
| Embodiment 5 (2-terminal type) | 9 | 5.4 |
| Embodiment 5 (3-terminal type) | 11 | 14.0 |
| Embodiment 6 | 11 | 7 |
| Embodiment 7 | 11 | 7 |
| Embodiment 8 | 11 | 7 (Effective value) |
| Embodiment 9 | 11 | 7 (Effective value) |
| Embodiment 10 (Single-wire type) | 11 | 7 |
| Embodiment 10 (Double-wire type) | 11 | 7 |

(TEST EXAMPLE 2)

Ceramic glow plugs used in embodiments 3 and 4 and embodiments 8 and 9 wherein current polarity was reversed and ceramic glow plugs used in a conventional circuit wherein current polarity was not reversed were subjected to a continuous current supply test for 300 hours at 1,250° C. The test results are shown in Table 3.

TABLE 3

| | Number of cracks |
|---|---|
| Embodiment 3 | 0/4 |
| Embodiment 4 | 0/4 |
| Embodiment 8 | 0/4 |
| Embodiment 9 | 0/4 |
| Single-wire glow plug (no polarity change) | 2/4 |
| Double-wire glow plug (no polarity change) | 4/4 |

(COMPARISON EXAMPLE 1)

Only direct current was repeatedly applied to the glow plugs shown in FIGS. 5 and 6 (*a*) at 1,000, 2,000, 3,000 and 5,000 cycles to perform temperature rise tests without reversing the current polarity or without switching the direct current to alternate current. The glow plugs were examined to check for crack generation. The test results are shown in Table 4.

Twenty samples were used for each test item. DC voltage of 4V was applied to the glow plugs shown in FIG. 5 and DC voltage of 14V was applied to the glow plugs shown in FIG. 6. The glow plugs were abruptly heated to 900° C. in about three seconds and the plug temperature was saturated at about 1,150° C. at test I and at about 1,250° C. at test II.

TABLE 4

| | Comparison examples | Applied voltage | Number of cracks 1,000 cycles | 2,000 cycles | 3,000 cycles | 5,000 cycles |
|---|---|---|---|---|---|---|
| I | Single-wire glow plug shown in FIG. 5 | 5.4 V | 0/20 | 0/20 | 2/20 | 6/20 |
| | Double-wire glow plug shown in FIG. 6 (a) | 14 V | 0/20 | 8/20 | 14/20 | 20/20 |
| II | Single-wire glow plug shown in FIG. 5 | 7 V | 0/20 | 0/20 | 4/20 | 8/20 |
| | Double-wire glow plug shown in FIG. 6 | (7) V | 0/20 | 0/20 | 2/20 | 6/20 |

(DEVELOPED EMBODIMENT)

Figure 13:
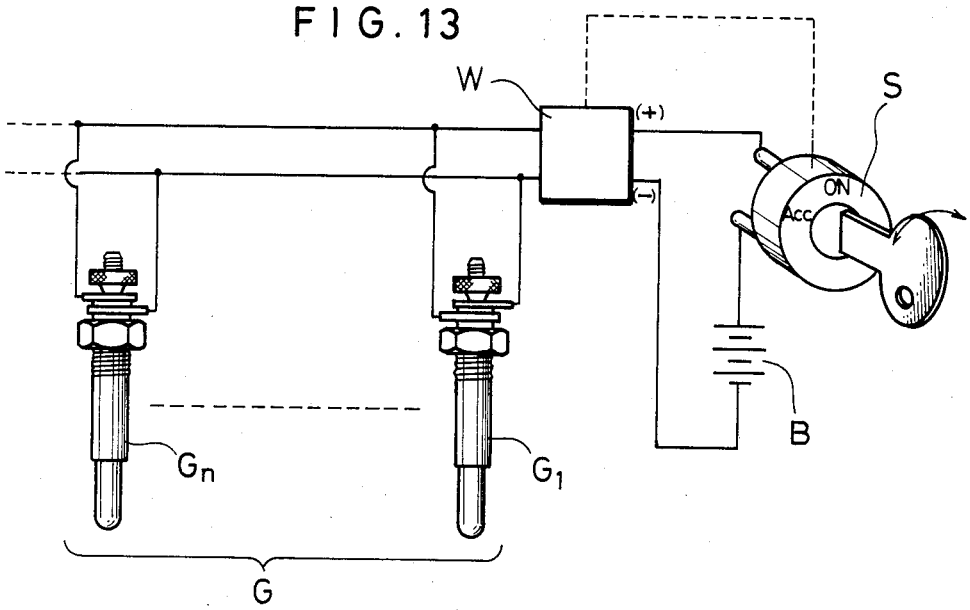
FIG. 13 is a basic circuit diagram of a developed embodiment of the glow plug current supply control device of the present invention.

In FIG. 13, the symbol S designates a key switch. This key switch S controls current supply to an engine starter, lamps and other electric devices (not shown). The key switch S also functions as a power switch to control current supply to the glow plugs $G_1, \ldots G_n$ as described below.

The symbol B designates a DC power supply of the DC supply circuit. The symbol W designates a current polarity swiching means which forms a switching circuit. Interlocked with the key switch S, this switching means W functions to switch the current polarity. The symbol G ($G_1, \ldots, G_n$) designates ceramic glow plugs. The glow plugs are made by embedding heating resistor wires made of a metal having a high melting point, such as tungsten or molybdenum in a ceramic body, such as silicon nitride ceramic having superior electric insulation, heat resistance and mechanical strength. Current is supplied from the leads installed at the rear end to the heating resistor wires of the glow plugs. In this case, glow plugs G are connected to the current polarity switching means W.

The current supply device having the basic constrution described above functions as described below. When the key switch S is set to the preheating contact ON position before starting the engine, current is supplied from the DC power supply B to the glow plugs via the closed contact of the switching means W as the first current supply step. The glow plugs G installed in the corresponding engine cylinders continue to heat the engine cylinders. The glow plugs G also continue to heat the cylinders for a required period even after the engine is started so that the engine can perform properly in the early stages of operation. When the key switch S is set to the preheating contact OFF position, the polarity of the current supplied from the switching means W to the load (glow plugs G) is reversed, interlocked with the operation of the key switch S. When the key switch S is set to the preheating contact ON position to start the engine, current flows from the DC power supply B to the glow plugs G as the second current supply step. The polarity of the current is opposite to that of the current of the first current supply step.

The switching means W described above switches the current polarity when the key switch S is set to the preheating contact OFF position. The switching means can be switched when the key switch S is set to the preheating contact ON position.

Figure 14:
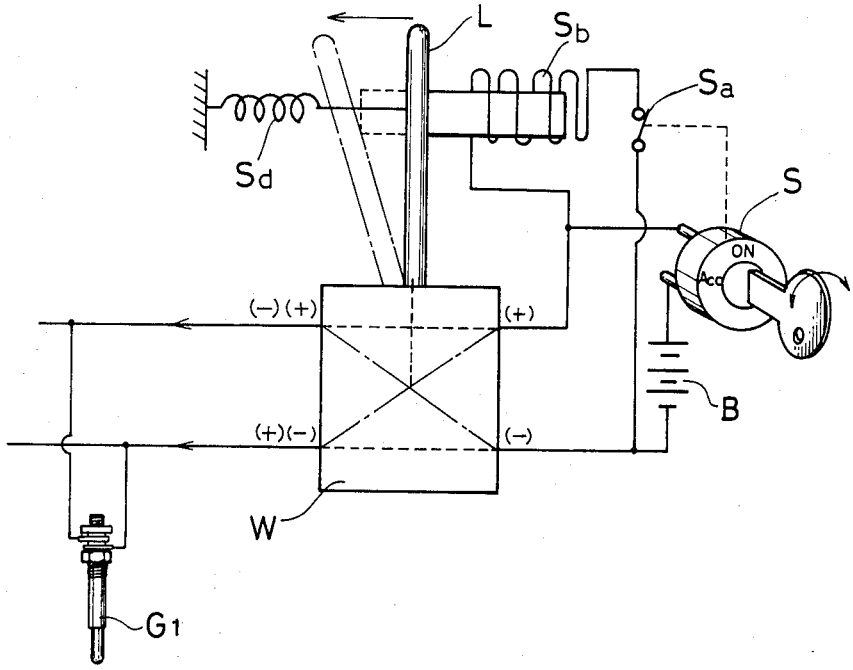
FIG. 14 is a part of the electric circuit diagram of the glow plug current supply control device shown in FIG. 13.

FIG. 14 more definitely shows a part of the current supply device of the present invention shown in FIG. 13. In FIG. 14, a switch Sa is turned on when the key switch S is set to the preheating contact ON position. A solenoid device Sb is activated to keep attracting a switching lever L. During this period, current is supplied from the DC power supply B to the glow plugs G via the contact which has been set by the previous preheating operation. The glow plugs G heat the engine cylinders to start and promote proper engine operation.

When the key switch S is set to the preheating contact OFF position, current to the glow plugs G is stopped. The switch Sa is also turned off and the solenoid Sb is deactivated. The lever L is pulled back by a spring Sd to the position indicated by the dotted line. The contact of the switching means W is switched so that the polarity of the current to be supplied next time is properly obtained.

Accordingly, the switching means W is constructed so that the current polarity switching contact is switched every time the lever L returns to the position indicated by the dotted line.

In the embodiment described above, the switching means W is switched every time the key switch S is set to the preheating contact ON position. The switching means W can be switched more than one time when the key switch S is set to the preheating contact ON position.

As easily understood from the above-mentioned embodiments and comparison examples, the glow plugs which were controlled by the current supply methods of embodiments 1 to 10 and the continuous current supply method of Test Example 2, wherein the current polarity was reversed in the temperature rising and dropping cycles, were not cracked even when the temperature was repeatedly raised to a high temperature of 1,150° C. or 1,250° C. On the other hand, numerous samples of the glow plugs to which only direct current was supplied without changing the polarity were cracked. In the continuous current supply test, the glow plugs controlled by the methods of the present invention were not cracked when they were heated to a high temperature of 1,250° C. It was inevitable that the glow plugs controlled by the conventional control method were cracked.

A ceramic heater, in which a metallic wire having a high melting point, made of molybdenum or tungsten, is embedded as a heating resistor wire, is hot-pressed and used in the above-mentioned embodiments. However, it is obvious to those people ordinarily skilled in the art that the current supply methods and devices of the present invention are applicable to all types of ceramic heaters, such as a ceramic heater which is made by coating metallic paste having a high melting point on a raw ceramic sheet, by covering the coated surface with a raw ceramic sheet or a semi-sintered ceramic layer and by sintering them into one piece.

Square wave can also be used as alternate current although normal alternating current is used in the above-mentioned embodiments.

As described above, the method and device of the present invention for supplying electric current to ceramic heaters comprising heating resistors embedded in ceramic sintered bodies, are characterized in that direct current is supplied from a direct current supply circuit as the first current supply step and the direction of the direct current supplied to the heating resistors at the first current supply step is reversed by a switching circuit or alternate current is supplied as the second current supply step. With this method and device, cracking of the ceramic sintered bodies of the ceramic heaters is eliminated or considerably reduced even when the heaters are repeatedly used for a long time at high temperatures. As a result, the reliability and durability of the ceramic heater can be greatly improved.

We claim:

1. A method of supplying electric current to a ceramic heater including a heating resistor embedded in a ceramic sintered body for heating said heating resistor, said method comprising:

supplying direct current of a given polarity to said heating resistor in a first current supply step to thereby raise said heating resistor to an elevated temperature; and supplying direct current of an opposite polarity to said heating resistor in a second current supply step, said direct current of opposite polarity having a magnitude sufficient to maintain a stable saturation temperature of said heating resistor, whereby ion movement in the ceramic sintered body is substantially reduced.

2. A method of supplying electric current to a ceramic heater including a heating resistor embedded in a ceramic sintered body for heating said heating resistor, said method comprising:

a first current supply step comprising supplying direct current of a given polarity to said heating resistor, a second current supply step comprising supplying direct current of an opposite polarity to said heating resistor, said first and second current supply steps being alternately performed in every other cycle, said cycle comprising a period between the start and stop of current supply, whereby said heating resistor is raised to an elevated temperature and maintained at a stable saturation temperature.

3. A method of supplying electric current according to claim 1 or 2, wherein said ceramic heater is a temperature saturation type of diesel engine glow plug which, in an initial current supply period, is abruptly heated to a high temperature range where fuel ignition is possible and then heated to a predetermined saturation temperature for a predetermined period until current supply is stopped.

4. A method of supplying electric current according to claim 1 or 2, wherein said ceramic heater comprises at least a pair of temperature saturation type diesel engine glow plugs which are connected in parallel and which, in an initial current supply period are abruptly heated to a high temperature range where fuel ignition is possible and then connected in series and heated to a predetermined saturation temperature for a predetermined period until current supply is stopped.

5. A device for supplying electric current to a ceramic heater including a heating resistor embedded in a ceramic sintered body for heating said heating resistor, said device comprising:

a direct current supply circuit for supplying direct current of a given polarity to said heating resistor of said ceramic heater at a first current supply step to thereby raise said heating resistor to an elevated temperature, a switching circuit which supplies alternating current to said heating resistor of said ceramic heater at a second current supply step, and a power switch for said ceramic heater, whereby ion movement in the ceramic sintered body is substantially reduced.

6. A device for supplying electric current to said ceramic heater according to claim 5, wherein said ceramic heater is a diesel engine glow plug and said device comprises a power switch and a current supply circuit which supply direct current to abruptly heat said glow plug to a high temperature range where fuel ignition is possible in an initial current supply period at said first current supply step, a temperature saturation control circuit which saturates glow plug temperature to a predetermined value, and a switching circuit which supplies alternating current to said heating resistor at said second current supply step.

7. A device for supplying electric current to said ceramic heater according to claim 5, wherein said ceramic heater is at least a pair of diesel engine glow plugs which are connected in parallel in an initial current supply period when said glow plugs are abruptly heated to a high temperature range where fuel ignition is possible and then connected in series when said glow plugs are heated to a predetermined saturation temperature, and said device comprises a power switch and a direct current supply circuit which supply direct current to said glow plugs which are connected in parallel in an initial current supply period at the first current supply step, a temperature saturation control circuit which saturates glow plug temperature to a predetermined value, and a switching circuit which supplies alternating current to said heating resistor at said second current supply step.

8. A device for supplying electric current to a ceramic heater including a heating resistor embedded in a ceramic sintered body for heating said heating resistor, said device comprising:

a direct current supply circuit which supplies direct current of a given polarity through said heating resistor of said ceramic heater at a first current supply step to thereby raise said heating resistor to an elevated temperature, a switching circuit for reversing the direction of said current of said first current supply step at a second current supply step to thereby supply direct current of an opposite polarity through said heating resistor, said direct current of opposite polarity having a magnitude sufficient to maintain a stable saturation temperature of said heating resistor, and a power switch for said ceramic heater, whereby ion movement in the ceramic sintered body is substantially reduced.

9. A device for supplying electric current to said ceramic heater according to claim 8, wherein said ceramic heater is a diesel engine glow plug and said device comprises a power switch and a current supply circuit which suppy direct current to abruptly heat said glow plug to a high temperature range where fuel ignition is possible in an initial current supply period at said first current supply step, a temperature saturation control circuit which saturates glow plug temperature to a predetermined value, and a switching circuit which reverses the direction of said direct current of said first current supply step to said heating resistor at said second current supply step.

10. A device for supplying electric current to said ceramic heater according to claim 8, wherein said ceramic heater is at least a pair of diesel engine glow plugs which are connected in parallel in an initial current supply period when said glow plugs are abruptly heated to a high temperature range where fuel ignition is possible and then connected in series when said glow plugs are heated to a predetermined saturation temperature, and said device comprises a power switch and a direct current supply circuit which supply direct current to said glow plugs which are connected in parallel in an initial current supply period at the first current supply step, a temperature saturation control circuit which saturates glow plug temperature to a predetermined value, and a switching circuit which reverses the direction of said direct current of said first current supply step to said heating resistor at said second current supply step.

11. A device for supplying electric current to said ceramic heater according to any one of claims 9, 10, 6 or 7, wherein one heating resistor is embedded in said ceramic sintered body and both ends of said heating resistor are exposed to the surface of said sintered body and used as two terminals.

12. A device for supplying electric current to said ceramic heater according to any one of claims 9, 10, 6 or 7, wherein two heating resistors are embedded in said ceramic sintered body and both ends of said heating resistors are exposed to the surface of said sintered body and used as terminals.

13. A device for supplying electric current to said ceramic heater according to any one of claims 9, 10, 6 or 7, wherein two heating resistors are embedded in said ceramic sintered body and both ends of said heating resistors are exposed to the surface of said sintered body and used as two terminals, neither of which is body-grounded.

14. A device for supplying electric current to said ceramic heater according to claims 6 or 7 wherein said alternating current is supplied from the alternator of a diesel engine.

15. A device for supplying electric current to said ceramic heater according to claim 8 or 5, wherein said power switch to supply current to said glow plug for heating is the engine starter switch of a car, and said first and second current supply steps are switched alternately every time said starter switch is turned on and off.

16. A device for supplying electric current to a ceramic heater including heating resistor means embedded in a ceramic sintered body, said device comprising:

direct current means for supplying direct current to said heating resistor means of said ceramic heater at a first current supply step to thereby raise said heating resistor means to an elevated temperature, switching circuit means for reversing the direction of said current to said heating resistor means at a second current supply step, and power switch means for actuating said ceramic heater, whereby ion movement in the ceramic sintered body is substantially reduced.

17. A device for supplying electric current to said ceramic heater according to claim 16, wherein said ceramic heater is a diesel engine glow plug and said device comprises power switch means and current suppply circuit means for supplying direct current to abruptly heat said glow plug to a high temperature range where fuel ignition is possible in an initial current supply period at said first current supply step, temperature saturation control means for circuit saturating glow plug temperature to a predetermined value, and switching circuit means for reversing the direction of said direct current of said first current supply step to said heating resistor means at said second current supply step.

18. A device for supplying electric current to a ceramic heater including heating resistor means embedded in a ceramic sintered body, said device comprising:

direct current supply circuit means for supplying direct current to said heating resistor means of said ceramic heater at a first current supply step to thereby raise said heating resistor means to an elevated temperature, switching circuit means for supplying alternating current to said heating resistor means at a second current supply step, and power switch means for actuating said ceramic heater, whereby ion movement in the ceramic sintered body is substantially reduced.

19. A device for supplying electric current to said ceramic heater according to claim 18, wherein said ceramic heater is a diesel engine glow plug and said device comprises power switch means and current supply circuit means for supplying direct current to abruptly heat said glow plug to a high temperature range where fuel ignition is possible in an initial current supply period at said first current supply step, temperature saturation control circuit means for saturating glow plug temperature to a predetermined value, and switching circuit means for supplying alternating current to said heating resistor at said second current supply step.

20. A method of supplying electric current to a ceramic heater including a heating resistor embedded in a ceramic sintered body for heating said heating resistor, said method comprising:

supplying direct current of a given polarity to said heating resistor in first current supply step to thereby raise said heating resistor to an elevated temperature; and supplying alternating current to said heating resistor in a second current supply step, whereby ion movement in the ceramic sintered body is substantially reduced.

21. A method of supplying electric current to a ceramic heater including a heating resistor embedded in a ceramic sintered body for heating said heating resistor, said method comprising:

a first current supply step comprising supplying direct current of a given polarity to said heating resistor, a second current supply step comprising supplying alternating current to said heating resistor, said first and second supply steps being alternately performed in every other cycle, said cycle comprising a period between the start and stop of current supply, whereby said heating resistor is raised to an elevated temperature and maintained at a stable saturation temperature.

* * * * *